United States Patent [19]

Tipton

[11] Patent Number: 4,734,446

[45] **Date of Patent: * Mar. 29, 1988**

[54] POLYMERIC COMPOSITIONS COMPRISING AN OIL-SOLUBLE POLYMER AND AN OIL-SOLUBLE ACRYLATE POLYMERIZATION OF PRODUCT

[75] Inventors: Craig D. Tipton, Perry, Ohio

[73] Assignee: The Lubrizol Corporation, Wickliffe, Ohio

[ * ] Notice: The portion of the term of this patent subsequent to Mar. 31, 2004 has been disclaimed.

[21] Appl. No.: 923,774

[22] Filed: Oct. 27, 1986

Related U.S. Application Data

[62] Division of Ser. No. 826,478, Feb. 5, 1986, Pat. No. 4,654,403, which is a division of Ser. No. 715,428, Mar. 25, 1985, Pat. No. 4,594,378.

[51] Int. Cl.[4] ..... C08L 23/10; C08L 23/18; C08L 25/08; C08L 33/06

[52] U.S. Cl. ..... 524/106; 524/123; 524/126; 524/200; 524/321; 524/401; 524/405; 524/415; 524/418; 524/516; 524/491; 524/522; 524/523; 525/194; 525/207; 525/221; 525/227; 525/375; 525/381; 525/382

[58] Field of Search ..... 525/227, 194, 207, 221; 524/516, 522, 523, 491, 106

[56] References Cited

U.S. PATENT DOCUMENTS

| | | | |
|---|---|---|---|
| 2,091,627 | 8/1937 | Bruson | 525/227 |
| 2,336,195 | 12/1943 | Sparks et al. | 525/227 |
| 2,600,422 | 6/1952 | Neher et al. | 260/78.5 |
| 2,600,449 | 6/1952 | Horne et al. | 260/78.5 |
| 2,628,220 | 2/1953 | Arundal et al. | 260/78.5 |
| 2,642,414 | 6/1953 | Baver et al. | 260/78.5 |
| 2,710,283 | 6/1955 | Linsk | 252/57 |
| 2,876,213 | 3/1959 | Bartlett et al. | 260/78.5 |
| 2,992,987 | 7/1961 | Fields | 252/56 |
| 3,156,743 | 11/1964 | Coover et al. | 525/227 |
| 3,283,036 | 11/1966 | Larson | 525/227 |
| 3,651,029 | 3/1972 | Fujimoto et al. | 260/78.5 |
| 3,806,442 | 4/1974 | Reid et al. | 525/227 |
| 3,849,353 | 11/1974 | Taft et al. | 525/227 |
| 3,933,761 | 1/1976 | Coleman | 260/78.5 T |
| 3,959,159 | 5/1976 | Coleman | 252/51.5 A |
| 4,496,691 | 1/1985 | Proux et al. | 525/73 |
| 4,594,378 | 6/1986 | Tipton et al. | 524/106 |

*Primary Examiner*—Carman J. Seccuro

*Attorney, Agent, or Firm*—Karl Bozicevic; Denis A. Polyn; Robert A. Franks

[57] ABSTRACT

Polymeric compositions comprised of particularly disclosed oil-soluble polymers and specific oil-soluble acrylate polymerization products are disclosed. The oil-soluble polymer (A) is a polymer selected from the group consisting of a non-aromatic mono-olefin having at least three carbon atoms, and a copolymer of the non-aromatic mono-olefin with an aromatic monoolefin, the polymer having a number average molecular weight of about 500 to about 100,000. The oil-soluble acrylate polymerization product (B) is at least one ester of the formula $CH_2{=}C(X){-}COOR$ wherein X is hydrogen or an alkyl or aryl group, and R is a monovalent hydrocarbyl group containing at least four carbon atoms, or an ether derivative of said hydrocarbyl group. The components (A) and (B) are preferably present in a weight ratio of (A):(B) of about 20:1 to about 1:10. The composition may further include an additional component (C) which is an effective amount of a low temperature viscosity reducing organic diluent characterized by a viscosity at 40° C. of less than four centistokes.

18 Claims, No Drawings

POLYMERIC COMPOSITIONS COMPRISING AN OIL-SOLUBLE POLYMER AND AN OIL-SOLUBLE ACRYLATE POLYMERIZATION OF PRODUCT

This is a divisional of co-pending application Ser. No. 826,478 filed on Feb. 5, 1986, now U.S. Pat. No. 4,654,403, which is a divisional of application Ser. No. 715,428 filed Mar. 25, 1985, now U.S. Pat. No. 4,594,378 issued June 10, 1986.

This application is a joint application based on U.S. application Ser. No. 673,686, filed Nov. 21, 1984, now abandoned. Benefit of the filing date of said earlier application is claimed for this application. The disclosure of said earlier application is incorporated herein by reference in its entirety.

TECHNICAL FIELD OF THE INVENTION

This invention relates to novel polymeric compositions, transmission fluids (i.e., automatic transmission fluids and manual transmission fluids) and hydraulic fluids. More particularly, the present invention relates to automatic transmission fluid and hydraulic fluid compositions containing the polymeric compositions of the present invention and characterized as having improved shear stability.

BACKGROUND OF THE INVENTION

The problems associated with the lubrication of automatic and manual transmissions and the operation of hydraulic fluid systems are well known to those skilled in the art. For example, in the lubrication of transmissions, proper fluid viscosity at both low and high temperatures is essential to successful operation. Good low temperature fluidity eases cold weather starting and insures that the hydraulic control system will properly "shift gears". High viscosity at elevated temperatures insures pumpability and the satisfactory functioning of converters, valves, clutches, gears and bearings.

In the operation of hydraulic fluid systems, proper fluid viscosity at both low and high temperatures is essential to successful operation. High temperature viscosity retention is beneficial in lubrication, contributes to streamline flow and reduces leakage. Good low temperature fluidity provides rapid control action, less heating loss and lower pressure drop.

These conflicting fluidity requirements call for a product that exhibits the following characteristics:

(A) high temperature viscosity retention, (B) low temperature fluidity, and (C) shear stability.

In order to prepare lubricants having these characteristics, it has become common practice to add a variety of chemicals to the oil. For example, in order to meet the viscosity requirements, compositions have been added to the oils which are characterized by relatively small changes in their viscosity with changing temperature, and they are commonly graded according to SAE standards according to the viscosities at low (e.g., 0° F.) and at high temperatures (e.g., 210° F.). As a result of the incorporation of such additives, the lubricating oils are often referred to as being "multi-graded". In terms of widely accepted concepts, such multi-graded lubricants have the desirable properties are being able to function immediately, though cold, upon being put into service, and to continue to function satisfactorily as they become heated during operation.

Although chemical compositions have been developed which improve the viscosity characteristics of lubricating oil, it is often desirable to further improve the low temperature characteristics by including compositions which function as fluidity modifiers at low temperatures. Fluidity modifiers are capable of lowering the viscosity of a lubricating oil at low temperatures generally by retarding the formation of undesirable microcrystalline wax substances.

In addition to the above improvements, it is desirable, if not necessary, that lubricating compositions especially designed for use as transmission fluids and hydraulic fluids exhibit shear stability. Shear stability means that the lubricating oils will not degrade or lose their desirable viscosity characteristics as a result of the shearing forces encountered during their use. Lubricating oil compositions exhibiting desirable shear stability will be found to generally have the viscosity within 85–95% of their original viscosity after a number of hours, (e.g., 100 hours) of service. It has been recognized that many ordinary viscosity index improvers commonly added to crankcase lubricating oils, such as high molecular weight polyisobutene and polyacrylates, do not possess the desired shear stability for use in improving the viscosity characteristics of transmission fluids and hydraulic fluids.

It now has been found that multi-grade lubricants exhibiting improved shear stability can be made by utilizing the compositions of the present invention. These lubricants are particularly useful in providing transmission fluids and hydraulic fluids.

SUMMARY OF THE INVENTION

Polymeric compositions are described which comprise a mixture of (A) at least one oil-soluble polymer which is a homopolymer of a non-aromatic monoolefin or a copolymer of said non-aromatic monoolefin with an aromatic monoolefin, and (B-1) at least one nitrogen-containing ester of a carboxy-containing interpolymer, and/or (B-2) at least one oil-soluble acrylate polymerization product of at least one acrylate ester, or a mixture of one or more of (B-1) and (B-2). The polymeric compositions of the invention also may contain (C) an effective amount of at least one low temperature viscosity-reducing liquid organic diluent such as a naphthenic oil or certain other natural and synthetic oils having the desired low temperature properties.

Polymeric compositions of the present invention are useful as additives in transmission fluids and hydraulic fluids, and the transmission fluids and hydraulic fluids containing the polymeric compositions of the present invention exhibit improved shear stability while maintaining desirable high and low temperature viscosity characteristics.

DETAILED DESCRIPTION OF THE PREFERRED EMBODIMENTS

The first component (A) of the polymeric compositions of the invention is at least one oil-soluble polymer which is a homopolymer of a non-aromatic monoolefin having at least 3 carbon atoms, or a copolymer of said non-aromatic monoolefin with an aromatic monoolefin, said polymer having a number average molecular weight of about 500 to about 100,000, and more preferably, a number average molecular weight of at least about 750. Still more preferably, the number average molecular weight of the polymer will be in the range of from about 750 to about 10,000.

The characterization of these polymers as oil-soluble does not necessarily mean they are soluble in all base oils in all proportions. Rather, the polymers are soluble in the base oils with which they are formulated to a degree sufficient to allow the lubricant composition to be multi-graded between SAE 75W and SAE 250.

The above-mentioned homopolymers can be prepared from non-aromatic monoolefins having at least 3 carbon atoms and preferably no more than 20 carbon atoms by a number of polymerization techniques well known to those of skill in the art. It should be noted that "homopolymer" as used herein, describes polymers made from monoolefins having the same number of carbon atoms. Thus, polymers made from a mixture of butene-1 and isobutylene are, in the terms of this specification and the appended claims, homopolymers of butylene. When they contain predominantly units derived from a single isomer, they may be referred to as polymers of that isomer; but, such terminology does not exclude the possibility of the presence of a minor amount of units derived from other isomers. Thus, a "polyisobutylene polymer" might contain units, 80% of which are derived from isobutylene, 15% from 1-butene and 5% from 2-butene.

Particularly preferred are homopolymers made from $C_3$ to $C_{20}$ monoolefins such as propene, 2-butene, isobutene, hexene-1, decene-3, tetradecene-4, etc. More preferable are homopolymers derived from $C_4$ to $C_8$ alpha-olefins such as butene, isobutene, pentene-1, heptene-1, etc. The most preferred homopolymers are those of propene and the various butenes.

The oil-soluble polymer (A) of the polymeric composition of this invention also may be copolymers of said non-aromatic monoolefins with one or more aromatic olefins. Copolymers containing at least 50% by weight of said non-aromatic olefin and up to about 50% by weight of an aromatic olefin are useful. The aromatic olefins are preferably vinyl aromatic monomers of up to 12 carbon atoms including styrene and substituted styrenes such as the methyl styrenes, alpha-halostyrenes, lower alkyl-substituted styrenes such as alpha-methylstyrene, alpha-ethylstyrene, para-tert-butylstyrene and para-lower alkoxystyrenes.

Techniques such as Ziegler, cationic, free-radical, anionic, emulsion polymerization and so forth can be used in appropriate circumstances to prepare these polymers. A particularly convenient technique for polymerizing such olefins for use in this invention is through the use of a Lewis acid catalyst such as aluminum chloride, boron trifluoride, titanium tetrafluoride and the like. These polymerizations are well known in the art and need not be described further at this point.

Among the polymers that are useful in the compositions of the present invention are the following: a polyisobutene of Mn 1400, a poly(1-octene) of Mn 4300, a poly(3-heptene) of Mn 900, a poly(1-eicosene) of Mn of 9500, a poly(1-nonene) of Mn 3700, a poly(2-methyl-1-pentene) of Mn 1700, a poly(5-ethyl-1-hexene) of Mn of 2200, and a poly(8-methyl-1-tetradecene) of Mn 1900.

In general, it is preferred that the homopolymers of the present invention, i.e., component (A), for reasons of oxidative stability, contain no more than 5% unsaturation on the basis of the total number of carbon-to-carbon covalent linkages present within an average molecule. Such unsaturation can be measured by a number of means well known to those of skill in the art, such as infrared, NMR, etc. More preferably these polymers contain no discernable unsaturation.

A particularly preferred polymer meeting all of the above requirements is polyisobutene, although other polymers such as polypropylene may also prove equally useful and desirable.

The transmission fluids of the invention preferably contain from about 0.1% to about 20% by weight of component (A). The hydraulic fluids of the invention preferably contain from about 0.1% to about 20%, more preferably about 2% to about 10% by weight by weight of component (A).

Component (B) of the polymeric composition of the invention is at least one of the following:

(B-1) at least one nitrogen-containing ester of a carboxy-containing interpolymer, said interpolymer having a reduced specific viscosity of from about 0.05 to about 2, said nitrogen-containing ester being characterized by the presence within its polymer structure of the following polar groups which are derived from the carboxy groups of said interpolymer:

(a) at least one carboxylic ester group having at least 8 aliphatic carbon atoms in the ester group, (b) at least one carbonylpolyamino group derived from a polyamino compound having one primary or secondary amino group and optionally (c) at least one carboxylic ester group having no more than 7 aliphatic carbon atoms in the ester group, or (B-2) at least one oil-soluble acrylate polymerization product of a least one ester of the formula $$CH_2{=}C(X){-}COOR$$

wherein

X is hydrogen or an alkyl or aryl group, and

R is a monovalent hydrocarbyl group containing more than four carbon atoms, or an ether derivative of said hydrocarbyl group.

Mixtures of B-1 and B-2 also are useful within the compositions of the invention, particularly with respect to hydraulic fluids.

As can be seen from the above, in one embodiment of the invention, the nitrogen-containing ester of a carboxy-containing interpolymer (B-1) contains within its polymer structure, at least two polar groups which are derived from the carboxy groups of said interpolymer. These polar groups are (a) at least one carboxylic ester group having at least 8 aliphatic carbon atoms in the ester group, and (b) at least one carbonyl-polyamino group derived from a polyamino compound having one primary or secondary amino group. In a second embodiment, the nitrogen-containing ester is characterized within its polymer structure of the above two groups identified as (a) and (b) and a third group (c) which is a carboxylic ester group having no more than 7 aliphatic carbon atoms in the ester group.

In reference to the size of the ester groups, it is pointed out that an ester group is represented by the formula $$-C(O)(OR)$$

and the number of carbon atoms in an ester group is thus the combined total of the carbon atom of the carbonyl group and the carbon atoms contained in the (OR) group.

When the nitrogen-containing ester (B-1) contains only polar groups (a) and (b), the molar ratio of (a) to (b) is generally within the range of from about 85:15 to about 99:1, and an especially preferred ratio is 95:5. When the nitrogen-containing ester (B-1) contains all three polar groups, namely, (a), (b) and (c), the polar groups are present at molar ratios of about (60–90):-(2–15):(10–30), respectively. A preferred ratio is about (70–80):(5):(15–25).

It should be noted that the linkage described as the carbonyl-polyamino group may be amide, imide, or amidine, and inasmuch as any such linkages contemplated within the present invention, the term "carbonyl-polyamino" is adopted as being a convenient, generic expression useful for the purpose of defining the polar groups (b). In a particularly advantageous embodiment of the invention, the linkage is imide or predominantly imide.

Another important element of component (B-1) is the molecular weight of the carboxy-containing interpolymer. For convenience, the molecular weight is expressed in terms of the "reduced specific viscosity" of the interpolymer which is a widely recognized means of expressing the molecular size of a polymeric substance. As used herein, the reduced specific viscosity (abbreviated as RSV) is the value obtained in accordance with the formula $$\text{RSV} = (\text{Relative Viscosity} - 1)/\text{Concentration}$$

wherein the relative viscosity is determined by measuring, by means of a dilution viscometer, the viscosity of a solution of one gram of the interpolymer in 100 ml. of acetone and the viscosity of acetone at 30°±0.02′ C. For purpose of computation by the above formula, the concentration is adjusted to 0.4 gram of the interpolymer per 100 ml. of acetone. A more detailed discussion of the reduced specific viscosity, also known as the specific viscosity, as well as its relationship to the average molecular weight of an interpolymer, appears in Paul J. Fory, *Principles of Polymer Chemistry,* (1953 Edition) pages 308 et seq.

While interpolymers having a reduced specific viscosity of from about 0.05 to about 1 are contemplated in the present invention, the preferred interpolymers are those having a reduced specific viscosity of from about 0.2 to 0.35 to about 0.8 or 1. Interpolymers having a reduced specific viscosity of from about 0.35 to about 0.5 or from about 0.65 to about 0.75 are particularly useful.

Mixtures of two or more compatible (i.e., nonreactive to one another) interpolymers which are separately prepared are contemplated herein for use in the esterification reaction, if each has a RSV as above described. Thus, as used herein, and in the appended claims, the terminology "interpolymer" refers to either one separately prepared interpolymer or a mixture of two or more of such interpolymers. A separately prepared interpolymer is one in which the reactants and/or reaction conditions are different from the preparation of another interpolymer.

The interpolymers are copolymers, terpolymers, and other interpolymers of alpha, beta-unsaturated dicarboxylic acids or derivatives thereof, or mixtures of two or more of any of these, and one or more vinyl aromatic monomers having up to 12 carbon atoms. The derivatives of the dicarboxylic acid are derivatives which are polymerizable with the monoolefinic compound, and as such, may be the esters and anhydrides of the acids. Copolymers of maleic anhydride and styrene are especially suitable, and such interpolymers having a RSV in the range from about 0.3 to about 1.8 (particularly 0.3 to about 0.9) are preferred.

Suitable alpha, beta-unsaturated dicarboxylic acids, anhydrides or lower alkyl esters thereof useful in the preparation of the interpolymers include those wherein a carbon-to-carbon double bond is in an alpha, beta-position to at least one of the carboxy functions (e.g., itaconic acid, anhydride or lower esters thereof) and preferably, in an alpha, beta-position to both of the carboxy functions of the alpha, beta-dicarboxylic acid, anhydride or the lower alkyl ester thereof (e.g., maleic acid, anhydride or lower alkyl esters thereof). Normally, the carboxy functions of these compounds will be separated by up to 4 carbon atoms, preferably 2 carbon atoms.

A class of preferred alpha, beta-unsaturated dicarboxylic acid, anhydrides of the lower alkyl esters thereof, includes those compounds corresponding to the formulae:

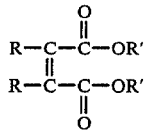
(I)

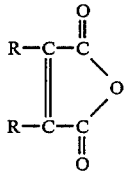
(II)

(including the geometric isomers thereof, i.e., cis and trans) wherein each R is independently hydrogen; halogen (e.g., chloro, bromo, or iodo); hydrocarbyl or halogen-substituted hydrocarbyl of up to about 8 carbon atoms, preferably alkyl, alkaryl or aryl; (preferably, at least one R is hydrogen); and each R′ is independently hydrogen or lower alkyl of up to about 7 carbon atoms (e.g., methyl, ethyl, butyl or heptyl). These preferred alpha, beta-unsaturated dicarboxlic acids, anhydrides or alkyl esters thereof contain a total carbon content of up to about 25 carbon atoms, normally up to about 15 carbon atoms. Examples include maleic anhydride; benzyl maleic anhydride; chloro maleic anhydride; heptyl maleate; citaconic anhydride; ethyl fumarate; fumaric acid; mesaconic acid; ethyl isopropyl maleate; isopropyl fumarate; hexyl methyl maleate; phenyl maleic anhydride and the like. These and other alpha, beta-unsaturated dicarboxylic compounds are well known in the art. Of these preferred alpha, beta-unsaturated dicarboxylic compounds, maleic anhydride, maleic acid and fumaric acid and the lower alkyl esters thereof are preferred. Interpolymers derived from mixtures of two or more of any of these can also be used.

Suitable vinyl aromatic monomers of up to about 12 carbon atoms which can be polymerized with the alpha, beta-unsaturated dicarboxylic acids, anhydrides or lower esters thereof are well known. The nature of the vinyl aromatic monomer is normally not a critical or essential aspect of this invention as these compounds serve primarily as a connective moiety for the alpha, beta-unsaturated compounds in forming the interpolymers. The vinyl aromatic compounds include styrene and substituted styrenes such as alpha-halostyrenes, lower alkyl-substituted styrenes such as alpha-methylstyrenes, para-tert-butylstyrenes, alpha-ethylstyrenes, and para-lower alkoxy styrenes. Mixtures of two or more vinyl aromatic monomers can be used.

Particularly preferred mixed alkyl esters of this invention are those of interpolymers made by reacting maleic acid, or anhydride or the lower esters thereof with styrene. Of these particularly preferred interpolymers those which are made of maleic anhydride and styrene and have a RSV in the range of about 0.3 to about 0.9 are especially useful. Of these latter preferred interpolymers, copolymers of maleic anhydride and styrene having a molar ratio of the maleic anhydride to styrene of about 1:1 are especially preferred. They can be prepared according to methods known in the art, as for example, free radical initiated (e.g., by benzoyl peroxide) solution polymerization. Examples of such suitable interpolymerization techniques are described in U.S. Pat. Nos. 2,938,016; 2,980,653; 3,085,994; 3,342,787; 3,418,292; 3,451,979; 3,536,461; 3,558,570; 3,702,300; and 3,723,375. These patents are incorporated herein by reference for their teaching of the preparation of suitable maleic anhydride and styrene containing interpolymers. Other preparative techniques are known in the art.

The molecular weight (i.e., RSV) of such interpolymers can be adjusted to the range required in this invention, if necessary, according to conventional techniques, e.g., control of the reaction conditions.

From the standpoint of utility, as well as for commercial and economical reasons, nitrogen-containing esters in which the ester group (a) has from 8 to 24 aliphatic carbon atoms, preferably about 12 to about 18 carbon atoms, and most preferably about 14 or 15 carbon atoms, the ester group (c) has from about 3 to about 5 carbon atoms, and the carbonyl polyamino group (b) is derived from a primary-aminoalkyl-substituted tertiary amine, particularly heterocyclic amine, are preferred. Specific examples of the carboxylic ester group containing at least 8 carbon atoms, i.e., the (OR) group of the ester radical (i.e., —(O)(OR)) include isooctyloxy, decyloxy, dodecyloxy, tridecyloxy, tetradecyloxy, pentadecyloxy, octadecyloxy, eicosyloxy, tricosyloxy, tetracosyloxy, etc. Specific examples of low molecular weight groups include methyloxy, ethyloxy, n-propyloxy, iso-propyloxy, n-butyloxy, sec-butyloxy, iso-butyloxy, n-pentyloxy, neo-pentyloxy, n-hexyloxy, cyclohexyloxy, cyclopentyloxy, 2-methyl-butyl-1-oxy, 2,3-dimethyl-butyl-1-oxy, etc. In most instances, alkoxy groups of suitable size comprise the preferred high and low molecular weight ester groups. Polar substituents may be present in such ester groups. Examples of polar substituents are chloro, bromo, ether, nitro, etc. Mixtures of the foregoing carboxylic ester groups can also be provided. For example, mixtures of ester groups having from 12 to 18 carbon atoms have been found to be useful. Mixtures of ester groups having 14 and 15 carbon atoms have been found to be particularly advantageous.

Examples of the carbonyl polyamino group include those derived from polyamino compounds having one primary or secondary amino group and at least one mono-functional amino group such as tertiary-amino or heterocyclic amino group. Such compounds may thus be tertiary-amino substituted primary or secondary amines or other substituted primary or secondary amines in which the substituent is derived from pyrroles, pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonamides, phosphoramides, phenolthiazines, amidines, etc. Examples of such polyamino compounds include dimethylamino-ethylamine, dibutylamino-ethylamine, 3-dimethylamino-1-propylamine, 4-methylethylamino-1-butylamine, pyridylethylamine, N-morpholino-ethylamine, tetrahydropyridylethylamine, bis-(dimethylamino)propylamine, bis-(diethylamino) ethylamine, N,N-dimethyl-p-phenylene diamine, piperidyl-ethylamine, 1-aminoethyl pyrazole, 1-(methylamino)pyrazoline, 1-methyl-4-aminooctyl pyrazole, 1-aminobutyl imidazole, 4-aminoethyl thiazole, 2-aminoethyl triazine, dimethylcarbamyl propylamine, N-methyl-N-aminopropyl acetamide, N-aminoethyl succinimide, N-methylamino maleimide, N-aminobutyl-alpha-chlorosuccinimide, 3-aminoethyl uracil, 2-aminoethyl pyridine, ortho-aminoethyl-N,N-dimethylbenzenesulfamide, N-aminoethyl phenothiazine, N-aminoethylacetamidine, 1-aminophenyl-2-methylimidazoline, N-methyl-N-aminoethyl-S-ethyldithiocarbamate, etc. Preferred polyamino compounds include the N-aminoalkyl-substituted morpholines such as N-3-aminopropyl morpholine. For the most part, the polyamino compounds are those which contain only one primary-amino or secondary-amino group and, preferably at least one tertiary-amino group. The tertiary amino group is preferably a heterocyclic amino group. In some instances polyamino compounds may contain up to about 6 amino groups although, in most instances, they contain one primary amino group and either one or two tertiary amino groups. The polyamino compounds may be aromatic or aliphatic amines and are preferably heterocyclic amines such as amino-alkyl-substituted morpholines, piperazines, pyridines, benzopyrroles, picolines, quinolines, pyrroles, pyrrolidinones, etc. They are usually alkyl amines having from 4 to about 30 carbon atoms, preferably from 4 to about 12 carbon atoms. Polar substituents may likewise be present in the polyamines.

In one embodiment, the nitrogen-containing esters of the invention (B-1) contain at least the two polar groups (a) and (b) derived from the carboxy groups of the interpolymer, and in another embodiment, the nitrogen-containing esters are mixed esters containing at least one of each of polar groups (a), (b) and (c).

The nitrogen-containing esters of the invention (B-1) are most conveniently prepared by first esterifying the carboxy-containing interpolymer with the higher molecular weight alcohol or a mixture of the high and low molecular weight alcohols to convert at least about 50% and no more than about 99% of the carboxy radicals of the interpolymer to ester radicals, and then neutralizing the remaining carboxy radicals with a polyamino compound such as described above. When the mixed esters are prepared, the molar ratio of the high molecular weight alcohol to the low molecular weight alcohol used in the process should be within the range of from about 2:1 to about 9:1. In most instances the ratio will be from about 2.5:1 to about 5:1. More than one high molecular weight alcohol or low molecular weight alcohol may be used in the process. Commercial alcohol mixtures such as the so-called Oxo-alcohols which comprise, for example, mixtures of alcohols having from 8 to about 24 carbon atoms also may be used.

A particularly useful class of alcohols are the commercial alcohol mixtures of mixtures of commercial alcohol mixtures comprising octyl alcohol, decyl alcohol, dodecyl alcohol, tridecyl alcohol, tetradecyl alcohol, pentadecyl alcohol, hexadecyl alcohol, heptadecyl alcohol and octadecyl alcohol. Commercial alcohol mixtures of tetradecyl and pentadecyl alcohols are particularly useful. Several suitable sources of these alcohols mixtures are the technical grade alcohols sold under the tradename "Neodols" by Shell Chemical Corporation and under the tradename "Alfols" by Continental Oil Company. Other alcohols useful in the process are illustrated by those which, upon esterification, yield the ester groups exemplified above.

The extent of esterification, as indicated previously, may range from about 50% to about 99%, preferably about 75% to about 97%, conversion of the carboxy radicals of the interpolymer to ester radicals. In a preferred embodiment, the degree of esterification is about 95%.

The esterification can be accomplished simply by heating the carboxy-containing interpolymer and the alcohol or alcohol mixtures under conditions typical for effecting esterification. Such conditions usually include, for example, a temperature of at least about 80° C., preferably from about 150° C. to about 350° C., provided that the temperature be below the decomposition point of the reaction mixture, and the removal of water of esterification as the reaction proceeds. Such conditions may optionally include the use of an excess of the alcohol reactant so as to facilitate esterification, the use of a solvent or diluent such as mineral oil, toluene, benzene, xylene or the like and an esterification catalyst such as toluene sulfonic acid, sulfuric acid, aluminum chloride, boron trifluoride-triethylamine, hydrochloric acid, ammonium sulfate, phosphoric acid, sodium methoxide or the like. These conditions and variations thereof are well known in the art.

A particularly desirable method of effecting esterification when mixed esters are desired involves first reacting the carboxy-containing interpolymer with the relatively high molecular weight alcohol and then reacting the partially esterified interpolymer with the relatively low molecular weight alcohol. A variation of this technique involves initiating the esterification with the relatively high molecular weight alcohol and before such esterification is complete, the relatively low molecular weight alcohol is introduced into the reaction mass so as to achieve a mixed esterification. In either event it has been discovered that a two-step esterification process whereby the carboxy-containing interpolymer is first esterified with the relatively high molecular weight alcohol so as to convert from about 50% to about 75% of the carboxy radicals to ester radicals and then with a relatively low molecular weight alcohol to achieve the finally desired degree of esterification results in products which have unusually beneficial viscosity properties.

The esterified interpolymer is then treated with a polyamino compound in an amount so as to neutralizes substantially all of the unesterified carboxy radicals of the interpolymer. The neutralization is preferably carried out at a temperature of at least about 80° C., often from about 120° C. to about 300° C., provided that the temperature does not exceed the decomposition point of the reaction mass. In most instances the neutralization temperature is between about 150° C. and 250° C. A slight excess of the stoichiometric amount of the polyamino compound is often desirable, so at to insure substantial completion of neutralization, i.e., no more than about 2–5% of the carboxy radicals initially present in the interpolymer remained unneutralized.

The following examples are illustrative of the preparation of the nitrogen-containing esters and mixed esters (B-1) used in the present invention. Unless otherwise indicated, all parts and percentages are by weight.

EXAMPLE 1-B-1

A styrene-maleic interpolymer is obtained by preparing a solution of styrene (536 parts) and maleic anhydride (505 parts) in toluene (7585 parts) and contacting the solution at a temperature of 99°–101° C. and an absolute pressure of 480–535 mm. Hg. with a catalyst solution prepared by dissolving benzoyl peroxide (2.13 parts) in toluene (51.6 parts). The catalyst solution is added over a period of 1.5 hours with the temperature maintained at 99°–101° C. Mineral oil (2496 parts) is added to the mixture. The mixture is maintained at 99°–101° C. and 480–535 mm. Hg. for 4 hours. The resulting product is a slurry of the interpolymer in the solvent mixture. The resulting interpolymer has a reduced specific viscosity of 0.42.

A toluene slurry (2507 parts), having 11.6% solids and 88.94% volatiles, of this maleic anhydride/styrene interpolymer Neodol 45 (631 parts), a product of Shell Chemical Company identified as a mixture of $C_{14}$ and $C_{15}$ linear primary alcohols, mineral oil (750 parts), and Ethyl Antioxidant 733 (4.2 parts), a product of Ethyl identified as an isomeric mixture of butyl phenols, are charged to a vessel. The mixture is heated with medium agitation under nitrogen purge at 0.5 standard cubic feet per hour until the temperature reaches 115° C. 70% methane sulfonic acid catalyst in water (10.53 parts) is added dropwise over a period of 20 minutes. Nitrogen purge is increased to 1.0 standard cubic feet per hour and temperature is raised by removal of toluene-water distillate. The mixture is maintained at a temperature of 150° C. for five hours under a nitrogen purge of 0.1–0.2 standard cubic feet per hour. Additional methane sulfonic acid solution (15.80 parts) is added to the mixture over a period of 15 minutes. The mixture is maintained at 150° C. for 3.5 hours. The degree of esterification is 95.08%. Amino propylmorpholine (35.2 parts) is added to the mixture dropwise over a period of 20 minutes. The mixture is maintained at 150° C. for an additional 30 minutes then cooled with stirring. The mixture is stripped from 50° C. to 141° C. at a pressure of 102 mm. Hg. then permitted to cool. At a temperature of 100° C., mineral oil (617 parts) is added. Cooling is continued to 60° C., diatomaceous earth (36 parts) is added and the mixture is heated to 100° C. The mixture is maintained at 100°–105° C. for one hour with stirring and then filtered to yield the desired product.

EXAMPLE 2-B-1

The procedure of Example 1-B-1 is repeated with the exception that both Neodol 45 (315.4 parts) and Alfol 1218 (312.5 parts), a product of Continental Oil Company identified as a mixture of synthetic primary straight chain alcohols having 12 to 18 carbon atoms, are initially charged, rather than the 631 parts of Neodol 45 which were included in the initial charge in Example 2.

EXAMPLE 3-B-1

A toluene slurry (1125 parts), having 13.46% solids and 86.54% volatiles, of the maleic anhydride/styrene interpolymer of Example 1-B-1 mineral oil (350 parts) and Neodol 45 (344 parts) are charged to a vessel. The mixture is heated with medium agitation under nitrogen sweep of 0.5 standard cubic feet per hour until the temperature reaches 110° C. Para-toluene sulfonic acid (8.55 parts) in water (9 parts) is added dropwise over a period of 24 minutes. The temperature of the mixture is increased to 152° C. by removing toluene-water distillate. The temperature is maintained at 152°-156° C. under nitrogen sweep of 0.5 standard cubic feet per hour until the net acid number indicates that esterification is at least 95% complete. Aminopropylmorpholine (15.65 parts) is added dropwise over a period of 10 minutes. The temperature of the mixture is maintained at 155° C. for one hour and then cooled under a nitrogen sweep. Ethyl Antioxidant 733 (1.48 parts) is added to the mixture. The mixture is stripped at 143° C. and 99 mm. Hg. pressure. The mixture is cooled under nitrogen sweep. Mineral oil is added to provide a total of 63% dilution. Ethyl Antioxidant 733 (1.79 parts) is added and the mixture is stirred for 30 minutes. The mixture is heated to 60° C. while stirring with a nitrogen sweep of 0.5 standard cubic feet per hour. Diatomaceous earth (18 parts) is added to the mixture. The mixture is heated to 90° C. The temperature of the mixture is maintained at 90°-100° C. for one hour and then filtered through a pad of diatomaceous earth (18 parts) in a heated funnel to yield the desired product.

EXAMPLE 4-B-1

The procedure of Example 3-B-1 is repeated with the exception that both Neodol 45 (172 parts) and Alfol 1218 (169 parts) are provided in the initial charge, rather than the 344 parts of Neodol 45 provided in Example 4.

EXAMPLE 5-B-1

The product of Example 1-B-1 (101 parts), Neodol 91 (56 parts), a product of Shell Chemical Company identified as a mixture of $C_9$, $C_{10}$, and $C_{11}$ alcohols, TA-1618 (92 parts), a product of Procter & Gamble identified as a mixture of $C_{16}$ and $C_{18}$ alcohols, Neodol 25 (62 parts), a product of Shell Chemical Company identified as a mixture of $C_{12}$, $C_{13}$, $C_{14}$, and $C_{15}$ alcohols, and toluene (437 parts) are charged to a vessel. The vessel is stirred and the contents are heated. Methane sulfonic acid (5 parts) is added to the mixture. The mixture is heated under reflux conditions for 30 hours. Aminopropyl morpholine (12.91 parts) is added to the mixture. The mixture is heated under reflux conditions for an additional 4 hours. Diatomaceous earth (30 parts) and a neutral paraffinic oil (302 parts) are added to the mixture which is then stripped. The residue is filtered to yield 497.4 parts of an orange-brown viscous liquid.

EXAMPLE 6-B-1

The product of Example 1-B-1 (202 parts), Neodol 91 (112 parts), TA 1618 (184 parts), Neodol 25 (124 parts) and toluene (875 parts) are charged to a vessel. The mixture is heated and stirred. Methane sulfonic acid (10 parts) is added to the mixture which is then heated under reflux conditions for 31 hours. Aminopropyl morpholine (27.91 parts) is added to the mixture which is then heated under reflux conditions for an additional 5 hours. Diatomaceous earth (60 parts) is added to the mixture which is then stripped, 600 parts of polymer remaining in the vessel. A neutral paraffinic oil (600 parts) is added to the mixture which is then homogenized. The mixture is filtered through a heated funnel to yield 1063 parts of a clear orange-brown viscous liquid.

EXAMPLE 7-B-1

The product of Example 1-B-1 (101 parts), Alfol 810 (50 parts), a product of Continental Oil Company identified as a mixture of $C_8$ and $C_{10}$ alcohols, TA-1618 (92 parts), Neodol 25 (62 parts) and toluene (437 parts) are charged to a vessel. The mixture is heated and stirred. Methane sulfonic acid (5 parts) is added to the mixture which is heated under reflux conditions for 30 hours. Aminopropyl morpholine (15.6 parts) is added to the mixture which is then heated under reflux conditions for an additional 5 hours. The mixture is stripped to yield 304 parts of a yellow-orange viscous liquid. Diatomaceous earth (30 parts) and a neutral paraffinic oil (304 parts) are added to the mixture which is then homogenized. The mixture is filtered through a heated funnel to yield 511 parts of a clear amber viscous liquid.

EXAMPLE 8-B-1

A toluene slurry (799 parts) of a maleic anhydride/styrene interpolymer (17.82% polymer) is charged to a vessel. The reduced specific viscosity of the interpolymer if 0.69. The vessel is purged with nitrogen while stirring the contents for 15 minutes. Alfol 1218 (153 parts), Neodol 45 (156 parts) and 93% sullfuric acid (5 parts) are added to the mixture. Toluene (125 parts) is then added to the mixture. The mixture is heated at 150°-156° C. for 18 hours. Aminopropyl morpholine (1.3 parts) is added to the mixture which is then heated for an additional one hour at 150° C. The mixture is cooled to 80° C. Ethyl Antioxidant 733 (1.84 parts) is added to the mixture. The mixture is stripped at 143° C. and the 100 mm. Hg. Mineral oil (302 parts) and Ethyl Antioxidant 733 (218 parts) are added and the mixture is stirred. The temperature of the mixture is maintained at 90° C. and is blown with nitrogen. Diatomaceous earth (44 parts) is added to the mixture which is stirred for one hour at 90°-95° C. The mixture is filtered through diatomaceous earth to yield 1312 parts of a dark-brown clear viscous liquid.

EXAMPLE 9-B-1

A toluene slurry (973 parts) of a maleic anhydride/styrene interpolymer (17.28% solids) is charged to a vessel. The reduced specific viscosity of the interpolymer is 0.69. The slurry is stirred and blown with nitrogen at 0.75-1.0 standard cubic feet per hour for 20 minutes. Neodol 45 (368 parts) and 80% sulfuric acid (6.84 parts) are added to the mixture. The mixture is heated at 150°-156° C. for 23 hours. Additional 80% sulfuric acid (1 part) and toluene (50 parts) are added after approximately the first 9 hours of heating. Additional 80% sulfuric acid (2.84 parts) is added after about the first 13 hours of heating. Additional Neodol 45 (18.4 parts) and 80% sulfuric acid (2 parts) are added after about the first 16 hours of heating. Aminopropyl morpholine (2.33 parts) is added to the mixture which is heated at 153°-154° C. for an additional one hour and 20 minutes. Ethyl Antioxidant 733 (2.06 parts) is added to the mixture. The mixture is stripped at 142° C. and 100 mm. Hg. Mineral oil (481 parts) is added to the mixture. Ethyl Antioxidant 733 (2.5 parts) is added to the mixture while the mixture is stirred. Diatomaceous earth (25 parts) is added to the mixture. The temperature of the mixture is maintained at 70° C. for 45 minutes and then heated to 110° C. Diatomaceous earth (25 parts) is added to the mixture. The mixture is filtered through diatomaceous earth to yield the desired product.

EXAMPLE 10-B-1

A toluene and mineral oil slurry (699 parts) containing 17.28% solids of a maleic anhydride/styrene interpolymer (reduced specific viscosity of 0.69), Neodol 45 (139 parts), Alfol 1218 (138 parts), Ethyl Antioxidant 733 (2.9 parts) and toluene (50 parts) are charged to a vessel. The mixture is heated under a nitrogen purge at 0.5 standard cubic feet per hour. 70% methane sulfonic acid (3.9 parts) is added dropwise over a period of 9 minutes. The mixture is heated under reflux conditions for 35 minutes. Toluene (51 parts) is added to the mixture which is then heated for an additional 3 hours 15 minutes under reflux conditions. 70% methane sulfonic acid (3 parts) is added dropwise over a period of 3 minutes. The mixture is heated under reflux conditions for 3 hours 15 minutes. 70% methane sulfonic acid (3.9 parts) is added dropwise over a period of 12 minutes. The mixture is heated at 150°-152° C. for 3 hours 45 minutes. Aminopropyl morpholine (14.3 parts) is added to the mixture dropwise over a period of 15 minutes. The mixture is maintained at a temperature of 149°-150° C. for an additional 30 minutes. The mixture is stripped at 140° C. and 100 mm. Hg. The mixture is cooled to 50° C. Mineral oil (338 parts) and diatomaceous earth (19 parts) are added to the mixture. The temperature of the mixture is maintained at 100°-105° C. for 1.5 hours and then filtered through additional diatomaceous earth (18 parts) to yield the desired product.

EXAMPLE 11-B-1

A styrene-maleic interpolymer is obtained by preparing a solution of styrene (16.3 parts by weight) and maleic anhydride (12.9 parts) in a benzene-toluene solution (270 parts; weight ratio of benzene:toluene being 66.5:33.5) and contacting the solution at 86° C. in nitrogen atmosphere for 8 hours with a catalyst solution prepared by dissolving 70% benzoyl peroxide (0.42 part) in a similar benzene-toluene mixture (2.7 parts). The resulting product is a thick slurry of the interpolymer in the solvent mixture. To the slurry there is added mineral oil (141 parts) while the solvent mixture is being distilled off at 150° C. and then at 150° C./200 mm. Hg. To 209 parts of the stripped mineral oil-interpolymer slurry (the interpolymer having a reduced specific viscosity of 0.72) there is added toluene (25.2 parts), n-butyl alcohol (4.8 parts), a commercial alcohol consisting essentially of primary alcohols having from 12 to 18 carbon atoms (56.6 parts) and a commercial alcohol consisting of primary alcohols having from 8 to 10 carbon atoms (10 parts) and to the resulting mixture there is added 96% sulfuric acid (2.3 parts). the mixture is then heated at 150°-160° C. for 20 hours whereupon water is distilled off. An additional amount of sulfuric acid (0.18 part) together with an additional amount of n-butyl alcohol (3 parts) is added and the esterification is continued until 95% of the carboxy radicals of the polymer has been esterified. To the esterified interpolymer, there is then added aminopropyl morpholine (3.71 parts; 10% in excess of the stoichiometric amount required to neutralize the remaining free carboxy radicals) and the resulting mixture is heated to 150°-160° C./10 mm. Hg. to distill off toluene and any other volatile components. The stripped product is mixed with an additional amount of mineral oil (12 parts) and filtered. The filtrate is a mineral oil solution of the nitrogen-containing mixed ester having a nitrogen content of 0.16-0.17%.

EXAMPLE 12-B-1

The procedure of Example 11-B-1 is followed except that the esterification is carried out in two steps, the first step being the esterification of the styrene-maleic interpolymer with the commercial alcohols having from 8 to 18 carbon atoms and the second step being the further esterification of the interpolymer with n-butyl alcohol.

EXAMPLE 13-B-1

The procedure of Example 11-B-1 is followed except that the esterification is carried out by first esterifying the styrene-maleic interpolymer with the commercial alcohols having from 8 to 18 carbon atoms until 70% of the carboxyl radicals of the interpolymer have been converted to ester radicals and thereupon continuing the esterification with any yet-unreacted commercial alcohols and n-butyl alcohol until 95% of the carboxyl radicals of the interpolymer have been converted to ester radicals.

EXAMPLE 14-B-1

The procedure of Example 11-B-1 is followed except that the interpolymer is prepared by polymerizing a solution consisting of styrene (416 parts), maleic anhydride (392 parts) in benzene (2153 parts) and toluene (5025 parts) in the presence of benzoyl peroxide (1.2 parts) at 65°-106° C. (The resulting interpolymer has a reduced specific viscosity of 0.45).

EXAMPLE 15-B-1

The procedure of Example 11-B-1 is followed except that the styrene-maleic anhydride is obtained by polymerizing a mixture of styrene (416 parts), maleic anhydride (392 parts), benzene (6101 parts) and toluene (2310 parts) in the presence of benzoyl peroxide (1.2 parts) at 78°-92° C. (The resulting interpolymer has a reduced specific viscosity of 0.91.)

EXAMPLE 16-B-1

The procedure of Example 11-B-1 is followed except that the styrene-maleic anhydride is prepared by the following procedure: Maleic anhydride (392 parts) is dissolved in benzene (6870 parts). To this mixture there is added styrene (416 parts) at 76° C. whereupon benzoyl peroxide (1.2 parts) is added. The polymerization mixture is maintained at 80°-821° C. for about 5 hours. (The resulting interpolymer has a reduced specific viscosity of 1.24.)

EXAMPLE 17-B-1

The procedure of Example 16-B-1 is followed except that acetone (1340 parts) is used in place of benzene as the polymerization solvent and that azobis-isobutyronitrile (0.3 part) is used in place of benzoyl peroxide as a polymerization catalyst.

EXAMPLE 18-B-1

The procedure of Example 11- B-1 is followed except that toluene sulfonic acid (3.5 parts) is used in place of sulfuric acid as the esterification catalyst.

EXAMPLE 19-B-1

The procedure of Example 11-B-1 is followed except that phosphoric acid (2.5 parts) is used in place of sulfuric acid as the esterification catalyst.

EXAMPLE 20-B-1

The procedure of Example 11-B-1 is followed except that dodecyl alcohol (0.7 mole per carboxy equivalent of the styrene-maleic anhydride interpolymer) is used in place of the alcohol mixtures having 8 to 18 carbon atoms and isobutyl) alcohol (0.2 mole per carboxy equivalent of the interpolymer) is used in place of n-butyl alcohol.

EXAMPLE 21-B-1

The procedure of Example 11-B-1 is followed except that eicosyl alcohol (0.8 mole consumed per carboxy equivalent of interpolymer) is used in place of the commercial alcohols having from 8 to 18 carbon atoms and n-pentyl alcohol (0.15 mole consumed per carboxy equivalent of the interpolymer) is used in place of the n-butyl alcohol.

EXAMPLE 22-B-1

The procedure of Example 11-B-1 is followed except that octyl alcohol (0.8 mole consumed per carboxy equivalent of the interpolymer) is used in place of the commercial alcohols having from 8 to 18 carbon atoms, isopentyl alcohol (0.1 mole consumed per carboxy equivalent of the interpolymer) is used in place of the n-butyl alcohol, and N-aminoethyl and 1-methyl-4-aminoethyl piperazine (0.1 mole consumed per carboxy equivalent of the interpolymer) is used in place of aminopropyl morpholine.

EXAMPLE 23-B-1

The procedure of Example 11-B-1 is followed except that dimethylamino-ethylamine is substituted for the aminopropyl morpholine used on a molar basis.

EXAMPLE 24-B-1

The procedure of Example 11-B-1 is followed except that dibutylamino-propylamine is substituted for the aminopropyl morpholine on a molar basis.

EXAMPLE 24-B-1

An interpolymer (0.86 carboxyl equivalent) of styrene and maleic anhydride (prepared from an equal molar mixture of styrene and maleic anhydride and having a reduced specific viscosity of 0.67–0.68) is mixed with mineral oil to form a slurry, and then esterified with a commercial alcohol mixture (0.77 mole; comprising primary alcohols having from 8 to 18 carbon atoms) at 150°–160° C. in the presence of a catalytic amount of sulfuric acid until about 70% of the carboxyl radicals are converted to ester radicals. The partially esterified interpolymer is then further esterified with n-butyl alcohol (0.31 mole) until 95% of the carboxyl radicals of the interpolymer are converted to the mixed ester radicals. The esterified interpolymer is then treated with aminopropyl morpholine (slight excess of the stoichiometric amount to neutralize the free carboxyl radicals of the interpolymer) at 150°–160° C. until the resulting product is substantially neutral (acid number of 1 to phenolphthalein indicator). The resulting product is mixed with mineral oil so as to form an oil solution containing 34% of the polymeric product.

EXAMPLE 26-B-1

The procedure of Example 11-B-1 is followed except that the aminopropyl morpholine used is replaced on a chemical equivalent basis with N-aminoethyl pyrrole.

EXAMPLE 27-B-1

The procedure of Example 11-B-1 is followed except that the aminopropyl morpholine used is replaced on a chemical equivalent basis with N-aminopropyl thiopyrrolidone.

EXAMPLE 28-B-1

The procedure of Example 11-B-1 is followed except that the aminopropyl morpholine used is replaced on a chemical equivalent basis with N-aminoethyl caprolactam.

EXAMPLE 29-B-1

The procedure of Example 11-B-1 is followed except that the aminopropyl morpholine used is replaced on a chemical equivalent basis with N-aminophenyl oxazolidone.

EXAMPLE 30-B-1

The procedure of Example 11-B-1 is followed except that the aminopropyl morpholine used is replaced on a chemical equivalent basis with 4-aminoethyl thiazole.

EXAMPLE 31-B-1

The procedure of Example 11-B-1 is followed except that the aminopropyl morpholine used is replaced on a chemical equivalent basis with 2-cyclohexyl triazine.

EXAMPLE 32-B-1

The procedure of Example 11-B-1 is followed except that the aminopropyl morpholine used is replaced on a chemical equivalent basis with 1-aminoethyl-2-heptadecylimidazoline.

EXAMPLE 33-B-1

The procedure of Example 11-B-1 is followed except that the aminopropyl morpholine used is replaced on a chemical equivalent basis with N-aminooctyl succinamide.

EXAMPLE 34-B-1

The procedure of Example 11-B-1 is followed except that the aminopropyl morpholine used is replaced on a chemical equivalent basis with 3-aminobutyl uracil.

EXAMPLE 35-B-1

The procedure of Example 11-B-1 is followed except that the aminopropyl morpholine used is replaced on a chemical equivalent basis with 4-aminobutyl pyridine.

The transmission fluids of the invention preferably contain from about 0.1% to about 10% by weight of component (B-1). The hydraulic fluids of the invention preferably contain from about 0.05% to about 10%, more preferably from about 0.1% to about 4% by weight of component (B-1).

The polymeric compositions of the present invention also may include as component (B), at least one oil-soluble acrylate polymerization product of at least one ester of the formula $$CH_2{=}C(X){-}COOR \qquad \text{(III)}$$

wherein X is hydrogen or an alkyl or aryl group, and R is a monovalent hydrocarbyl group containing more than 4 carbon atoms, or an ether derivative of said hydrocarbyl group. For convenience, these acrylate polymerization products will be identified herein as component (B-2).

Compounds of the above types represented by Formula III whose oil-soluble polymers are particularly useful for the present purpose are the esters of acrylic acid or of its alpha-alkyl or alpha-aryl substitution products and monohydric alcohols containing at least four carbon atoms such as the butyl, amyl, hexyl, heptyl, octyl, nonyl, decyl, lauryl, myricyl, cetyl, or octadecyl esters of acrylic acid, alpha-methacrylic acid, alpha-phenylacrylic acid, and other alpha-substituted homologues of acrylic acid. These esters are preferably those of the normal, primary saturated aliphatic alcohols, but the analogous esters of the corresponding secondary or of the branched-chain alcohols can also be used. The esters of the above acids of the acrylic series with monohydric aromatic, hydroaromatic, or ether alcohols may also be used, such as the benzyl, cyclohexyl, amylphenyl, n-butyloxyethyl esters.

These esters are employed in the form of their oil-soluble polymers which should be as free as possible of unpolymerized monomeric esters, since the presence of unsaturated or volatile compounds in the transmission fluid may be objectionable. Unpolymerized esters can be removed by heating the polymer or the mixture of lubricating oil and polymer in vacuo to a temperature sufficiently high to volatilize the monomeric ester, but preferably the polymerization should be carried out as completely as possible and the latter operation dispensed with.

The most effective polymers for the present purpose, from the point of view of availability and power of increasing the desirable properties are the polymerized esters of acrylic acid or alpha-methacrylic acid and monohydric, saturated, primary aliphatic alcohols containing from 4 to 22 carbon atoms in the molecule. The esters possessing the highest solubility and stability in oils and giving the highest viscosity index are those derived from the straight chain, monohydric primary, saturated aliphatic alcohols containing 8 to 20 carbon atoms such as the normal octyl, lauryl, cetyl, or octadecyl esters. These esters need not be pure, but may be prepared from technical mixtures of the higher aliphatic alcohols such as are obtained commercially from the catalytic high pressure hydrogenation of fatty acids or their esters.

The acrylate ester monomers are prepared by standard esterification techniques through the reaction of acrylic acid or substituted acrylic acid such as methacrylic acid with an alcohol or alcohol mixture such as with technical grades of long chain primary alcohols. These commercially available alcohols are mixtures of n-alkanols of various chain lengths containing between about 4 and 22 carbons in the alkyl group. Several suitable sources of these alcohol mixtures are the technical grade alcohols sold under the tradename "Neodols" by Shell Chemical Corporation and under the tradename "Alfols" by Continental Oil Company.

Any mixture of two or more polymers of the esters set forth herein can also be used. These may be simple mixtures of such polymers, or they may be co-polymers which can be prepared by polymerizing a mixture of two or more of the monomeric esters.

The polymers are prepared for use in the present process, preferably by heating the monomeric esters at 70°–100° C. in the presence of small amounts of polymerization-inducing catalysts such as peroxides or ozonides. These are referred to as "heat polymerization products". Other catalysts may, however, be used, such as anhydrous halides of polyvalent or amphoteric metals, according to the known art of polymerizing vinyl compounds.

Procedures for the preparation of acrylate polymers (B-2) useful in this invention are known in the art such as in U.S. Pat. Nos. 2,100,993; 3,598,736; and 3,679,644. The disclosures of these patents are hereby incorporated by reference.

The hydraulic fluids of the invention preferably contain from about 0.1% to about 10%, more preferably about 0.5% to about 5% by weight of component (B-2).

The compositions of the present invention also may, and preferably do, contain (C) an effective amount of at least one low temperature viscosity-reducing liquid organic diluent. Generally, the diluent (C) is characterized as having a viscosity at 40° C. of less than 4 centistokes, and more preferably a viscosity at 40° C. of between about 2.0 and about 3.8 centistokes.

The diluent (C) may be any organic diluent having the desired viscosity reducing characteristics, and such diluents may be natural or synthetic diluents. Among the preferred organic diluents exhibiting the desirable viscosity characteristics are the naphthenic oils, certain synthetic oils and alkylated aromatic materials. The naphthenic oils which are useful in the compositions of the invention are those derived from naphthenic crudes such as found in the Louisiana area. The viscosity of such naphthenic oils at 40° C. generally is less than 4 centistokes and more generally within the range of from about 3.0 to about 3.8 centistokes. At 100° C., the viscosity of the desirable naphthenic crudes is within the range of about 0.8 to about 1.6 centistokes. Such naphthenic oils have been found to provide excellent fluidity characteristics to the polymeric compositions of the invention, particularly at low temperature.

The synthetic oils useful as diluent (C) are those having a viscosity at 40° C. of from about 2.0 to 3.8 centistokes and preferably between about 2.0 and 3.0 centistokes. Examples of such oils include the esters of dicarboxylic acids (e.g., phthalic acid, succinic acid, alkyl succinic acids, azeleic acid, malonic acid) with a variety of alcohols including, for example, butyl alcohol, dodecyl alcohol, etc. The synthetic oils, especially the ester types, which are useful as diluent (C) are described in more detail below.

The alkylated aromatic materials that are particularly useful as the diluent (C) in the hydraulic fluid compositions of the invention. These alkylated aromatic materials are preferably mono- or di- (more preferably mono-) substituted benzenes wherein the substituents are hydrocarbon-based groups of about 8 to about 30, preferably about 10 to about 14 carbon atoms. An example is a commercially available mixture of alkylated benzenes containing a 2% maximum of $<C_{10}$, a 10% maximum of $C_{10-12}$, 70–90% of $C_{13-14}$, and a 5% maximum of $<C_{14}$ hydrocarbon groups.

The amount of low temperature viscosity reducing liquid organic diluent included in the compositions of the present invention is an amount which is effective to reduce the viscosity of the composition to the desired level at low temperatures, particularly at temperatures below 0° C. Accordingly, the amount of diluent (C)

included in the polymeric compositions of the invention will depend upon the amounts and relative amounts of components (A) and (B) present in the composition, the properties of the particular diluent, and the viscosity characteristics desired in the final product. Generally, the weight ratio of diluent (C) to the mixture of components (A) and (B) will be in the range of about 5:1 to about 1:5. In the case of transmission fluids, the diluent (C) is preferably present at a level of from about 1% to about 90% by weight. With hydraulic fluids, the diluent (C) is preferably present at a level of from about 1% to about 35%, more preferably from about 2% to about 10% by weight.

The compositions of this invention comprising mixtures of components (A), (B) and (C) described above are useful in a variety of lubricating compositions formulated for a variety of uses. In particular, the compositions of this invention are useful in the formulation of transmission fluids (i.e., both automatic and manual transmission fluids) and hydraulic fluids exhibiting improved and desirable low temperature characteristics. The compositions of this invention provide excellent low temperature fluidity.

Furthermore, the transmission fluids and hydraulic fluids of the present invention have the unexpected combination of high shear stability, excellent low temperature fluidity, and 100° C. viscosity equivalent to conventionally formulated fluids.

When the compositions of the present invention comprising components (A), (B) and (C) are to be utilized in lubricating oil formulations, and in particular, in transmission fluids and hydraulic fluids, the compositions of the present invention will contain, in addition to components (A), (B) and (C), other additives which impart certain desirable properties to the transmission fluids and hydraulic fluids. Such additives include, for example, detergents and dispersants of the ash-producing or ashless type, corrosion- and oxidation-inhibiting agents, pour point depressing agents, extreme pressure agents, anti-wear agents, rust-inhibiting agents, seal swell agents, friction modifiers, color stabilizers and anti-foam agents.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature of about 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Pat. No. 1,306,529 and in many U.S. patents including the following U.S. Pat. Nos.:

| | | |
|---|---|---|
| 3,163,603 | 3,351,552 | 3,541,012 |
| 3,184,474 | 3,381,022 | 3,543,678 |
| 3,215,707 | 3,399,141 | 3,542,680 |
| 3,219,666 | 3,415,750 | 3,567,637 |
| 3,271,310 | 3,433,744 | 3,574,101 |
| 3,272,746 | 3,444,170 | 3,576,743 |
| 3,281,357 | 3,448,048 | 3,630,904 |
| 3,306,908 | 3,448,049 | 3,632,510 |
| 3,311,558 | 3,451,933 | 3,632,511 |
| 3,316,177 | 3,454,607 | 3,697,428 |
| 3,340,281 | 3,467,668 | 3,725,441 |
| 3,341,542 | 3,501,405 | 4,234,435 |
| 3,346,493 | 3,522,179 | Re 26,433 |

(2) Reaction products of relatively high molecular weight aliphatic or alicyclic halides with amines, preferably olyalkylene polyamines. These may be characterized as "amine dispersants" and examples thereof are described for example, in the following U.S. Pat. Nos.: 3,275,554; 3,454,555; 3,438,757; 3,565,804.

(3) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following illustrative U.S. Pat. Nos.:

| | | |
|---|---|---|
| 2,459,112 | 3,442,808 | 3,591,598 |
| 2,962,442 | 3,448,047 | 3,600,372 |
| 2,984,550 | 3,454,497 | 3,634,515 |
| 3,036,003 | 3,459,661 | 3,649,229 |
| 3,166,516 | 3,461,172 | 3,697,574 |
| 3,236,770 | 3,493,520 | 3,725,277 |
| 3,355,270 | 3,539,633 | 3,725,480 |
| 3,368,972 | 3,558,743 | 3,726,882 |
| 3,413,347 | 3,586,629 | 3,980,569 |

(4) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,422 |

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos. 3,329,658; 3,449,250; 3,519,565; 3,666,730; 3,687,849; 3,702,300.

The above-noted patents are incorporated by reference herein for their disclosures of ashless dispersants.

The detergents/dispersants, when employed, are used at a level of from about 0.01% to about 20% by weight, or higher depending on the nature of the dispersant. Usually, such detergents/dispersants are employed at a level of from about 0.1% to about 15% by weight based on the total weight of the transmission fluid.

Extreme pressure agents and corrosion- and oxidation-inhibiting agents which may be included in the compositions of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphoridithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned extreme pressure agents and corrosion-oxidation inhibitors also serve as anti-wear agents. Zinc dialkylphosphorodithioates are a well known example.

Anti-wear agents that are particularly useful in the hydraulic fluid compositions of the invention are those anti-wear agents made by contacting a salt of a phosphorus acid of the formula $(R'O)_2PSSH$, wherein each R′ is independently a hydrocarbon-based group, or the phosphorus acid precursors thereof with at least one phosphite of the formula $(R''O)_3P$, wherein R″ is a hydrocarbon-based group, under reaction conditions at a temperature of about 50° C. to about 200° C. R′ is preferably an alkyl group of about 3 to about 50 carbon atoms, and R″ is preferably aromatic. The salt is preferably a zinc salt, but can be a mixed salt of at least one of said phosphorus acids and at least one carboxylic acid. These anti-wear agents are described more fully in U.S. Pat. No. 4,263,150, which is incorporated herein by reference. These anti-wear agents as well as the anti-wear agents referred to above can be provided in the hydraulic fluid compositions of the invention at levels of about 0.1% to about 5%, preferably about 0.25% to about 1% by weight based on the total weight of said fluid compositions.

The oxidation inhibitors that are particularly useful in the hydraulic fluid compositions of the invention are the hindered phenols (e.g., 2,6-di-(t-butyl)phenol); aromatic amines (e.g., alkylated diphenyl amines); alkyl polysulfides; selenides; borates (e.g., epoxide/boric acid reaction products); phosphorodithioic acids, esters and/or salts; and the dithiocarbamate (e.g., zinc dithiocarbamates). These oxidation inhibitors as well as the oxidation inhibitors discussed above are preferably present in the hydraulic fluids of the invention at levels of about 0.05% to about 5%, more preferably about 0.25 to about 2% by weight based on the total weight of such compositions.

The rust-inhibitors that are particularly useful in the hydraulic fluid compositions of the invention are the alkenyl succinic acids, anhydrides and esters, preferably the tetrapropenyl succinic acids, acid/esters and mixtures thereof; metal (preferably calcium and barium) sulfonates; the amine phosphates; and the imidazolines. These rust-inhibitors are preferably present in the hydraulic fluids of the invention at levels of about 0.01% to about 5%, preferably about 0.02% to about 1% by weight based on the total weight of said fluids.

Pour point depressants may be included in the compositions described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones of organic polymers. Additional anti-foam compositions are described in "Foam Control Agents", by Henty T. Kerner (Noyes Data Corporation, 1976), pages 125–162.

When additional additives are used with the compositions of the present invention in formulating transmission fluid and hydraulic fluid compositions, the additional additives are used in concentrations in which they are normally employed in the art. Thus, they will generally be used in a concentration of from about 0.001% up to about 25% by weight of the total composition, depending, of course, upon the nature of the additive and the nature of the automatic transmission fluid composition.

The transmission fluid and hydraulic fluid compositions of the present invention may, of course, be prepared by a variety of methods known in the art. One convenient method is to combine the composition of the present invention comprising components (A), (B), and (C) described above and the additional additives in the form of a concentrated solution or substantially stable dispersion (i.e., an additive concentrate) to a sufficient amount of a base oil which may be an additional amount of the diluent (C) described above or any other natural or synthetic oil normally used in the preparation of such transmission fluids or hydraulic fluids to form the desired final transmission fluid or hydraulic fluid composition. Such concentrates contain the additives in proper amounts so as to provide the desired concentration of each additive in the final automatic transmission fluid or hydraulic fluid composition when blended with a predetermined amount of a base oil.

As mentioned above, the compositions of the present invention comprising components (A), (B) and (C) and other optional and desirable additives may be blended with additional diluent such as component (C) or other natural and synthetic base oils.

The base oils used in preparing the transmission fluids and hydraulic fluids of the invention can be natural oils or synthetic oils. Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butyl-phenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

The following examples illustrate the compositions of the present invention. Unless otherwise indicated, all parts and percentages are by weight.

EXAMPLE A

A composition is prepared which comprises 35 parts by weight of a polyisobutylene having a number average molecular weight of 900 and 5 parts of a nitrogen- and boron-containing compound of Example 1-B-1.

EXAMPLE B

A composition suitable for the formation of an automatic transmission fluid is prepared which comprises 35 parts of a polyisobutylene having a number average molecular weight of 900, 5 parts of the product of Example 1-B-1 and 30 parts of a naphthenic hydrocarbon oil having a viscosity at 40° C. of about 3.5 centistokes.

EXAMPLE C

A composition suitable for use in the preparation of automatic transmission fluids is prepared comprising 35 parts of a polyisobutylene having a number average molecular weight of about 900, 5 parts of the product of Example 1-B-1, 29 parts of a commercially available naphthenic oil having a viscosity at 40° C. of about 3.5 centistokes, 9.52 parts of the reaction product of polyisobutenyl succinic anhydride with ethylene polyamine and carbon disulfide, 1.67 parts of a seal sweller prepared as in U.S. Pat. No. 4,029,587, and 1.33 parts of silicone anti-foam agent.

Examples of hydraulic fluid formulations of the invention are indicated in the table below. In the following table, all numerical values are in parts by weight.

| | D | E | F |
|---|---|---|---|
| 100 Neutral Mineral Oil | 92.2 | 88.17 | 91.11 |
| Product of Example 1-B-1 | 1.17 | 1.8 | 1.35 |
| Polyisobutylene (Mn = 1400) | 4.24 | 6.52 | 4.89 |
| Alkylate 230 (a product of Monsanto identified as an alkylated benzene having a molecular weight of about 260) | 1.05 | 1.61 | 1.21 |
| Acryloid 150 (a product of Rohm & Haas identified as a methacrylate copolymer) | 0.052 | 0.081 | 0.060 |
| Acryloid 156 (a product of Rohm & Haas identified as a methacrylate copolymer) | 0.155 | 0.238 | 0.179 |
| Zinc di(2-ethylhexyl) dithiophosphate | 0.371 | 0.53 | 0.371 |
| Sodium petroleum sulfonate | 0.0506 | 0.03 | 0.0506 |
| Antioxidant 732 (product of Ethyl identified as alkylated phenol) | 0.151 | 0.18 | 0.151 |
| Tolad 370 (product of Petrolite identified as a solution of a polyglycol in aromatic hydrocarbons) | 0.01 | 0.008 | 0.01 |
| Sulfurized calcium salt of dodecyl phenol | 0.05 | 0.07 | 0.05 |
| Tolyltriazole | 0.00165 | 0.001 | 0.00165 |
| Acrylate terpolymer derived from 2-ethylhexyl acrylate, ethyl acrylate and vinyl acetate | 0.015 | — | 0.015 |
| Diluent oil | 0.48 | 0.76 | 0.569 |

While the invention has been described herein with respect to its prepared embodiments and illustrated by the presentation of specific examples, it is to be understood that various modifications thereof will be apparent to those skilled in the art upon reading the specification. It is intended that such modifications are within the scope of the invention which is limited only by the appended claims.

I claim:

1. A polymeric composition comprising a mixture, comprising:

(A) an oil-soluble polymer selected from the group consisting of a homopolymer of a non-aromatic mono-olefin having at least three carbon atoms, and a copolymer of the non-aromatic mono-olefin with an aromatic monoolefin, said polymer having a number average molecular weight of about 500 to about 100,000; and (B) which is a mixture containing both (B-1) and (B-2), wherein (B-1) is a nitrogen-containing ester of a carboxy-containing interpolymer derived from at least two monomers, one of said monomers being an aliphatic olefin or a vinyl aromatic monomer, the other of said monomers being (ii) at least one alpha, beta-unsaturated aliphatic carboxylic acid, anhydride or ester thereof, the interpolymer having a reduced specific viscosity of from about 0.05 to about 2, the nitrogen-containing ester being characterized by the presence within its polymer structure of the following polar groups which are derived from the carboxy group of the interpolymer:

(a) at least one carboxylic ester group having at least 8 aliphatic carbon atoms in the ester group, and (b) at least one carbonyl-polyamino group derived from reacting a carboxy group of said interpolymer with a polyamino compound having one primary or secondary amino group and at least one tertiary amino or heterocyclic amino group; and (B-2) is an oil-soluble acrylate polymerization product of at least one ester of the formula $$CH_2{=}C(X){-}COOR \qquad \text{(III)}$$

wherein X is hydrogen or an alkyl or aryl group, and R is a monovalent hydrocarbyl group containing at least four carbon atoms, or an ether derivative of said hydrocarbyl group.

2. The polymeric composition of claim 1 wherein (A) is a homopolymer and is derived from a $C_3$–$C_{20}$ olefin.

3. The polymeric composition of claim 2 wherein the homopolymer is derived from a $C_4$–$C_8$ alpha-olefin.

4. The polymeric composition of claim 3 wherein the homopolymer is derived from propene or a butene.

5. The polymeric composition of claim 4 wherein the polymer has a number average molecular weight of about 750 to about 10,000.

6. The polymeric composition of claim 1 wherein the weight ratio of (A):(B) is from about 20:1 to 1:10.

7. The composition of claim 6 wherein X is hydrogen or a methyl group, and R contains from about 8 to about 20 carbon atoms.

8. The composition of claim 1 wherein (B-2) is a mixture of esters derived from a mixture of alcohols.

9. The composition of claim 1, further comprising:

(C) an effective amount of low temperature viscosity reducing liquid organic diluent.

10. The composition of claim 9 wherein the diluent (C) is characterized as having a viscosity at 40° C. of less than four centistokes.

11. The composition of claim 10 wherein the diluent (C) is a naphtenic oil or a synthetic oil having a viscosity at 40° C. of from about 2.0 to about 3.8 centistokes.

12. The polymeric composition of claim 9 wherein the weight ratio of diluent (C) to the combination of (A) and (B) is from about 5:1 to about 1:5.

13. The polymeric composition as claimed in claim 1, further comprising an oxidation inhibitor selected from the group consisting of hindered phenols, aromatic amines, alkyl polysulfides, selenides, borates, phosphorodithioic acids, esters and salts thereof, and dithiocarbamates.

14. The polymeric composition as claimed in claim 13, wherein the oxidation inhibitor is present in an amount in the range of from about 0.05 to about 5% based on the total weight of the composition.

15. The polymeric composition as claimed in claim 14, wherein the oxidation inhibitor is present in an amount in the range of from about 0.25% to about 2% by weight based on the weight of the composition.

16. The polymeric composition as claimed in claim 13, further comprising a rust inhibitor selected from the group consisting of alkenyl succinic acids, anhydrides, and esters thereof, metal sulfonates, amine phosphates, and imidazolines.

17. The polymeric composition as claimed in claim 16, wherein the rust inhibitor is present in an amount in the range of from about 0.01% to about 5% by weight based on the weight of the composition.

18. The polymeric composition as claimed in claim 17, wherein the rust inhibitors are present in an amount in the range of from about 0.02% to about 1% by weight based on the weight of the composition.

* * * * *